US005622147A

United States Patent [19]

Edelmayer

[11] Patent Number: 5,622,147

[45] Date of Patent: Apr. 22, 1997

[54] HYDRAULIC LASH ADJUSTER

[75] Inventor: Thomas C. Edelmayer, Battle Creek, Mich.

[73] Assignee: Eaton Corporation, Cleveland, Ohio

[21] Appl. No.: 613,273

[22] Filed: Mar. 8, 1996

[51] Int. Cl.[6] ..... F01L 1/16; F01L 1/24

[52] U.S. Cl. ..... 123/90.35; 123/90.36; 123/90.46; 123/90.55; 74/569

[58] Field of Search ..... 123/90.35, 90.36, 123/90.46, 90.48, 90.49, 90.52, 90.55, 90.57, 90.58; 74/569

[56] References Cited

U.S. PATENT DOCUMENTS

| | | | |
|---|---|---|---|
| 2,870,755 | 1/1959 | Dayton | 123/90.55 |
| 2,943,611 | 7/1960 | Dadd | 123/90.55 |
| 2,956,557 | 10/1960 | Dadd | 123/90.55 |
| 3,877,445 | 4/1975 | Barnes | 123/90.55 |
| 4,184,464 | 1/1980 | Svihlik | 123/90.55 |
| 4,402,285 | 9/1983 | Arai et al. | 123/90.46 |
| 4,530,319 | 7/1985 | Honda | 123/90.46 |
| 4,807,576 | 2/1989 | Sonoda et al. | 123/90.57 |
| 4,942,854 | 7/1990 | Shirai et al. | 123/90.17 |

*Primary Examiner*—Weilun Lo
*Attorney, Agent, or Firm*—Frank M. Sajovec

[57] ABSTRACT

A hydraulic lash adjuster which includes a seal element acting between the body and the plunger. The check valve of the lash adjuster is normally open, and effective leakdown to compensate for negative lash is provided by controlling the distance traveled by the check valve in moving from its open to its closed position.

8 Claims, 2 Drawing Sheets

HYDRAULIC LASH ADJUSTER

The present invention relates generally to hydraulic lash adjusters, and more particularly to a hydraulic lash adjuster which incorporates a dynamic seal between the body and plunger.

Hydraulic lash adjusters for internal combustion engines have been in use for many years to eliminate clearance, or lash, between engine valve train components under varying operating conditions in order to maintain efficiency and to reduce noise and wear in the valve train. Hydraulic lash adjusters operate on the principle of transmitting the energy of the valve actuating cam through hydraulic fluid trapped in a pressure chamber behind a plunger. During each operation of the cam, as the length of the valve actuating components vary due to temperature changes, small quantities of hydraulic fluid are permitted to enter or escape from the pressure chamber and thus effect an adjustment in the position of the plunger and consequently an adjustment of the effective total length of the valve train. The cam operating cycle comprises two distinct events: base circle and valve actuation. The base circle event is characterized by a constant radius between the cam center of rotation and the cam follower during which effectively no cam energy is transmitted. The valve actuation event is characterized by a varying radius between the cam center of rotation and the cam follower which effectively transmits cam energy to open and close an engine valve. During the valve actuation event, a portion of the loads due to the valve spring, the inertia of valve train components, and cylinder pressure are transmitted through the valve train and through the lash adjuster. The load raises the pressure of the hydraulic fluid within the lash adjuster pressure chamber in proportion to the plunger area, and in current hydraulic lash adjusters, causes some fluid to escape between the plunger and the wall of the lash adjuster body. As the fluid escapes, the plunger moves down according to the change in volume of the pressure chamber, shortening the effective length of the valve train. During the base circle event, the lash adjuster plunger spring moves the plunger up such that no clearance or lash exists between valve actuation components. Hydraulic fluid is drawn into the pressure chamber through the plunger check valve in response to the increased volume of the pressure chamber as the plunger moves up. If the effective length of the valve train shortens during the cam cycle, positive lash is created and the lash adjuster extends, moving the plunger to a higher position at the end of the cycle than at the beginning. Inversely, if the effective length of the valve train lengthens during the cam cycle, negative lash is created and the lash adjuster contracts, moving the plunger to a lower position at the end of the cycle than at the beginning. The latter condition typically occurs when valve train components lengthen in response to increased temperature.

In current hydraulic lash adjusters the escape of hydraulic fluid from the pressure chamber is between the plunger and the wall of the lash adjuster body Such escape or "leakdown" is controlled solely by the fit of the plunger within the body. Effective operation of the lash adjuster requires that the leakdown be precisely controlled and thus a distinct leakdown surface must be provided between the plunger and the body, and the fit between (he plunger and the body must be held to a very close clearance, e.g. 0.000200 in. (0.00508 mm) and 0.000230 in. (0.00584 mm). Such close clearances require selective fitting of the plunger to the body, which is an expensive operation.

Attempts have been made to eliminate the selective fit and resulting expense by using means other than controlled leakage between the plunger and the body, thus permitting a much larger clearance between the plunger and the body, with the pressure in the high pressure chamber being maintained by the use of one or more elastomeric seals. Current seal technology makes it fairly easy to maintain pressure within a hydraulic lash adjuster wherein the plunger and body are fabricated to fairly loose tolerances. Not so easy is the provision of a controlled leakdown by means other than precision machining and select fit. Examples of prior art attempts to accomplish the above are the use of a porous plug in the side wall of the plunger, a ball check valve in the plunger wall, controlled flow past the seal, and leakdown surfaces formed on elements of a two-piece plunger, as shown in U.S. Pat. Nos. 2,943,611 and 2,956,557. Such schemes have not been successful, however, as indicated by the fact that both of the above patents issued in 1960, yet all hydraulic tappets currently used in production still use precisely machined leakdown surfaces and select fits.

It is thus an object of the present invention to provide a hydraulic lash adjuster which does not require an extremely precise fit between the lash adjuster plunger and the body in which it is received and which thus can be more economically manufactured than has been heretofore possible.

To meet the above objectives the present invention provides a hydraulic lash adjuster wherein the fit between the plunger and body is relatively loose in comparison with prior art designs, wherein a resilient seal between the plunger and the body is used to maintain a pressure seal between the high and low pressure regions of the lash adjuster, and wherein effective leakdown is obtained by providing a normally open check valve and closely controlling the movement of the check valve between its open and closed positions, wherein during the initial portion of the valve actuation event some hydraulic fluid escapes from the high pressure chamber as the flowing fluid closes the check valve. The plunger then moves downward according to the change in volume of the pressure chamber, thus shortening the effective length of the valve train. The use of free ball check valves, which are inherently normally open, is well known in the art, as shown for example by U.S. Pat. Nos. 4,184,464; 4,530,319 and 4,807,576; however, none of the prior art lash adjusters employing such check valves which are known to the applicants herein provide the precise control of check valve movement as a means to provide effective leakdown, as is contemplated by the present invention.

Other objects and advantages of the invention will be apparent from the following description when considered in connection with the accompanying drawings, wherein.

Figure 1:
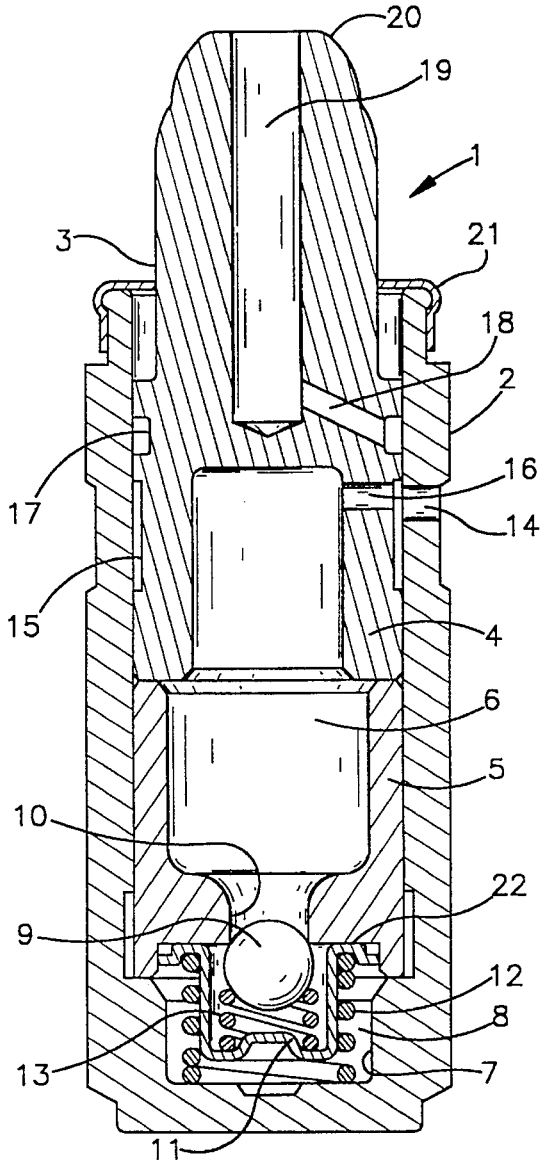
Fig.1 (PRIOR ART)
FIG. 1 is a cross-sectional view of a prior art hydraulic lash adjuster.

Referring to FIG. 1, there is illustrated a prior art lash adjuster 1 having a body 2, a plunger assembly 3 defined by an upper plunger element 4 and a lower plunger element 5 which are received within the body in close fitting relationship and which define a low pressure chamber 6 between them. The bottom of the lower plunger element 5 forms, in cooperation with the end of a reduced diameter portion 7 of the body bore, a high pressure chamber 8. A check valve 9 is provided in the end of a passage 10 which connects the high and low pressure chamber 5. The check valve, which is shown as a ball but which can be a flat disk or the like, is retained by a cage 11 which is in interference fit with a counterbore 22 formed in the lower plunger element and which provides a seat for the lash adjuster plunger spring 12. In accordance with the most prevalent design practice a bias spring 13 acting between the bottom of the cage 11 and the check valve 9 biases the check valve into a normally closed position.

An oil entry port 14 opens into the body bore and intersects a collector groove 15 which intersects a radial port 16 in the upper plunger member to supply hydraulic fluid to the chamber 6. A second collector groove 17 and port 18 in the upper plunger member provides metered hydraulic fluid to an axial bore 19 to supply lubricant to a rocker arm (not shown) which engages a modified ball end 20 formed on the end of the upper plunger member, metering being provided by means of a controlled clearance between the plunger and the bore in the area of the land between the port 14 and the collector groove 17. The plunger is retained within the body by means of a cap 21.

In the prior art embodiment shown in FIG. 1, leakdown is controlled by the fit between the body bore and the outside diameter of the bottom plunger member 5, requiring the diametral clearance between these members to be held very precisely, e.g. between 0.000200 in. (0.00508 mm) and 0.000230 in. (0.00584 mm), which can only be achieved by machining the individual parts to extremely close tolerances and selectively pairing the plunger members and the bodies to achieve the desired clearance.

Figure 2:
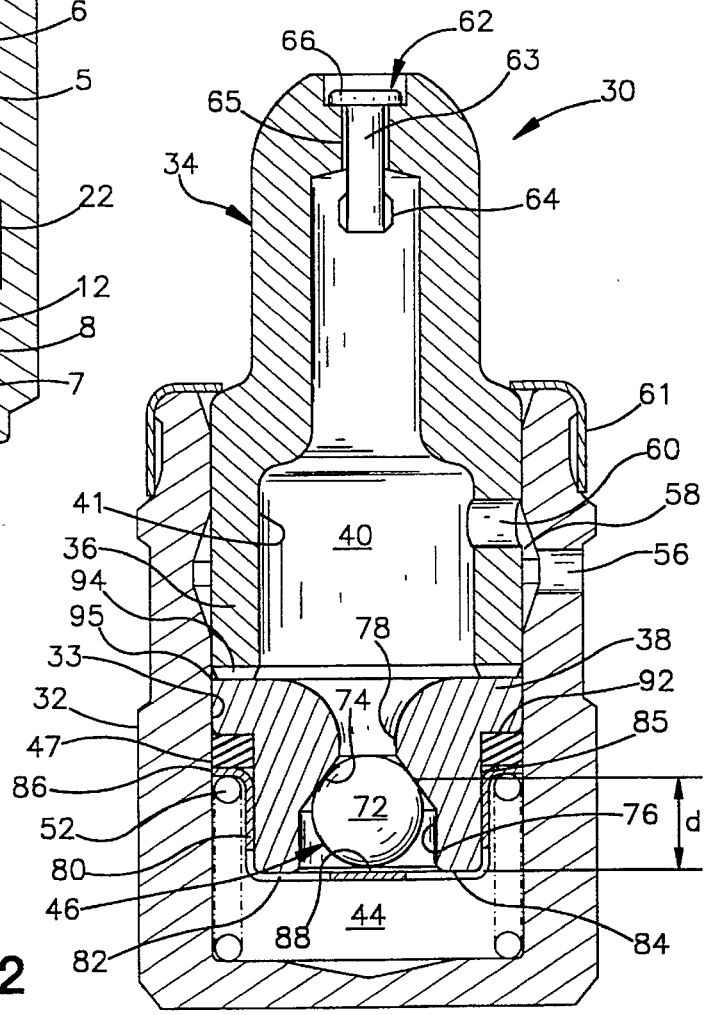
FIG. 2 is a cross-sectional view of a lash adjuster incorporating the present invention.

Referring to FIG. 2, the lash adjuster 30 of the present invention comprises a body 32 having a blind bore 33 formed therein, a plunger assembly 34 including an upper plunger element 36 and a lower plunger element 38 received in the bore 33, a low pressure chamber or reservoir 40 defined by a first axial stepped bore 41 formed in the upper plunger element, a high pressure chamber 44 defined between the bottom of the lower plunger element and the bottom of the body bore 33, a check valve assembly 46 in the lower plunger element, a seal 47 acting between the lower plunger member and the bore 33, and a plunger spring 52.

In the preferred embodiment illustrated, hydraulic fluid is supplied to the chamber 40 through a port 56 which opens into the bore 33 and intersects a collector groove 58 which also intersects a port 60 in the upper plunger element opening into the chamber 40. A cap 61 retains the plunger assembly in accordance with normal practice. Metered hydraulic fluid is supplied to the rocker arm by means of a valve 62 which allows a limited flow of fluid outward of the plunger but which acts as a check valve to prevent the inflow of air in the event of a low or negative pressure condition within the low pressure chamber 40. The valve 62 is in the form of a pin 63 having outwardly extending portions 64 which can be compressed to snap the valve into place through a port 65 formed in the end of the upper plunger, and a head 66 formed thereon to define the check valve. While the embodiment illustrated in FIG. 2 is a preferred embodiment, it can be appreciated that other means such as gravity flow or a self-contained supply can be provided to supply fluid to the chamber 40 and that hydraulic fluid can also be provided to the rocker arm as illustrated in the prior art embodiment shown in FIG. 1 or by other means, without affecting the scope of the present invention.

The check valve assembly 46 comprises a ball 72, a seat 74 which is defined by a surface formed at the intersection of a bore 76 in the bottom of the lower plunger element 38 with a bore 78 connecting the chamber 40 with the bore 76, and retainer 80 which retains the ball within the bore 76. In the illustrative embodiment, the retainer 80 is in the form of a cup having areas 82 cut away to allow hydraulic fluid flow into the chamber 44 and which is retained against the bottom surface 84 of the lower plunger element by means of an interference fit with an area of reduced diameter 85 formed on the lower plunger element. The plunger spring 52 acts against a flange portion 86 of the retainer. In the preferred embodiment of the invention the seat 74 is a conical surface, which serves to guide the ball to the seat and thus provides more consistent closing action than would be the case if the seat was defined by an edge. It can be appreciated, however, that the seat could be formed by an edge defined by the intersection of the bores 76 and 78 without departing from the basic concept of the invention.

To provide the close control of check valve travel contemplated by the present invention the ball 72 is completely enclosed within the bore 76, as compared with the open construction of the prior art lash adjuster shown in FIG. 1, and the distance d between the contact surface of the seat 74 and surface 88 of the retainer is set, in relation to the diameter of the ball 72, at a predetermined value corresponding to a desired effective leakdown rate. While somewhat precise dimensioning is required to minimize variation of the distance d, the only critical dimension in production is the location of the seat 74 relative to the surface 84, which is easily controlled and which does not involve the degree of precision or select fitting required by the prior art lash adjusters. Other critical dimensions are the ball size and the flatness of the surfaces 84 and 88; however, extremely precisely dimensioned balls are essentially a commodity, and the flatness of the above components is easily controlled.

In accordance with the invention, the seal 47 is received over the reduced diameter portion 85 of the lower plunger element 38 and is retained axially by the shoulder 92 defined by the intersection between the diameter 85 and the outside diameter of the plunger element 38 and by the flange 86 of the retainer 80, thus eliminating the need to form a seal-receiving groove in the plunger element. When the seal is initially installed on the lower plunger element and the plunger assembly is inserted into the body, a slight clearance may exist between the seal outer diameter and the body bore 33 until the lash adjuster is installed in an engine and the seal is energized into engagement with the plunger and the body by pressure within the chamber 44.

In practice, lash adjusters are filled with hydraulic fluid at assembly so that they will not be completely dry at initial startup of the engine. In the present lash adjuster there is the possibility that the initial fluid fill can be inadvertently lost due to the relatively large clearance between the plunger and the body and between the unenergized seal and the body. Accordingly, means can be provided to recirculate hydraulic fluid from the high pressure chamber which may escape past the seal back into the low pressure chamber. In the preferred embodiment shown in FIG. 2, a low resistance recirculation path is provided by radial grooves 94 formed in the bottom of the upper plunger element 36 (which can alteratively be formed in the lower plunger element) communicating with a collector groove defined by a chamber 95 formed at the bottom of the upper plunger element (which chamber can also be formed in the lower plunger element).

By comparing the FIG. 1 and FIG. 2 embodiments, it can be appreciated that the elimination of the leakdown surface between the plunger and the body permits the plunger to be made much shorter in the inventive embodiment, thus decreasing the overall length of the lash adjuster.

With the elimination of the need for selectively fitting the plungers with the bodies, the present invention also makes it feasible to install the plunger assembly 4 directly into a blind bore, corresponding to the body bore 33, formed directly in the head of an engine, wherein the head effectively serves as the lash adjuster body.

Figure 3:
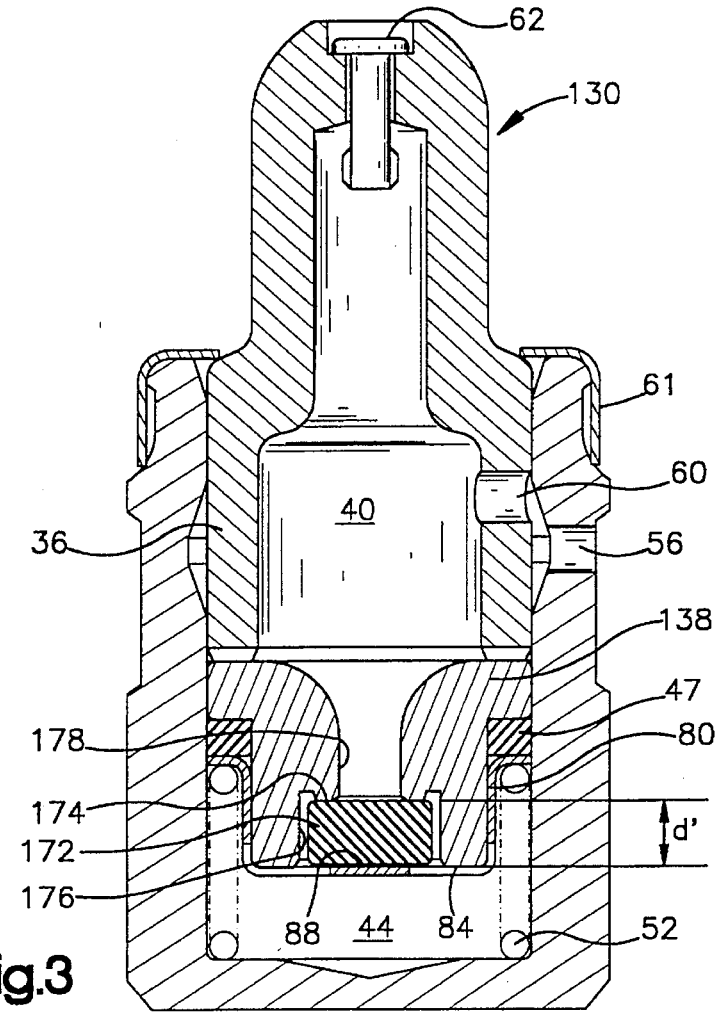
FIG. 3 is a cross-sectional view of an alternative embodiment of the present invention.

Referring to FIG. 3, there is illustrated an alternative embodiment 130 of the invention which is identical to the embodiment shown in FIG. 2 except in the construction of the check valve assembly. In this embodiment the ball is replaced by a disk element 172 which closes against a seat 174 formed at the intersection of bore 176 in the bottom of the lower plunger element 138 with bore 178. As in the FIG. 2 embodiment, check valve travel is controlled by the selection of distance d', between the seating surface 174 and surface 88 of the retainer 80 in relation to the thickness of the disk 172.

Figure 4:
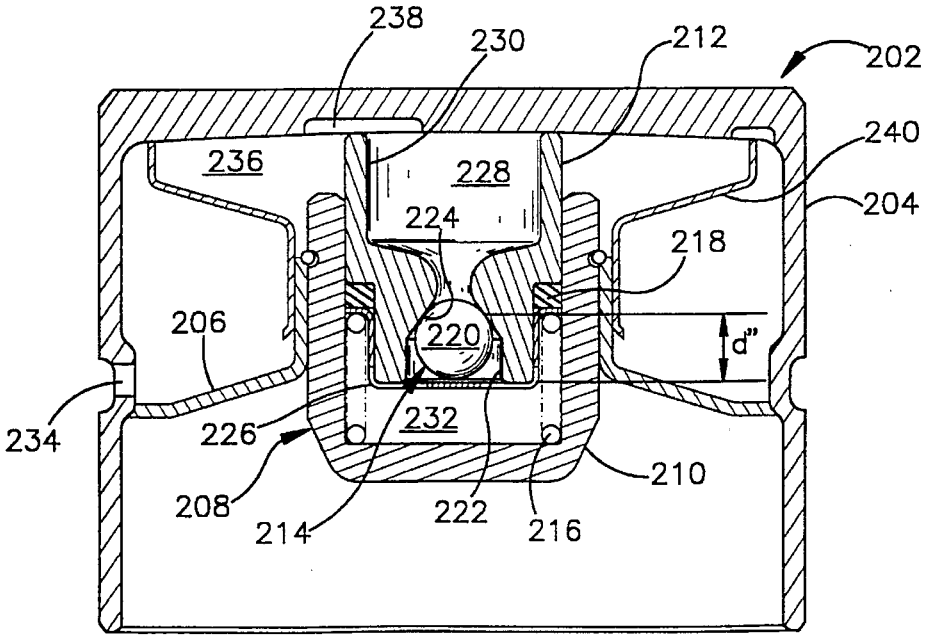
FIG. 4 is a cross-sectional view of the invention as applied to a direct acting lash adjuster.

FIG. 4 illustrates the application of the present invention to a direct acting lash adjuster 202, comprising a cup-shaped body 204, a web and hub element 206 and a hydraulic assembly 208, as is well known.

In accordance with the invention, the hydraulic assembly comprises a piston 210, which corresponds to the body in the FIG. 2 embodiment, in sliding engagement with the hub portion of the web and hub element; a plunger 212, corresponding to the plunger in the FIG. 2 embodiment, in sliding engagement with the piston; a check valve assembly 214 received in the plunger; a plunger spring 216 acting between the piston and the plunger; and a seal 218 acting between the plunger and the piston. As in the FIG. 2 embodiment, the check valve assembly comprises a ball 220 received within a bore 222 formed in the plunger, a seat 224 formed in the plunger, and a retainer 226. A low pressure chamber 228 is defined by a bore 230 in the plunger and the top portion of the body, and a high pressure chamber 232 is defined between the check valve assembly and the bottom of the piston 210. As in the FIG. 2 embodiment, check valve movement in within the bore 222 is controlled by the distance d" between the seat and the retainer in relation to the diameter of the ball.

In the FIG. 4 embodiment, hydraulic fluid flow is through a port 234 in the body 204 into a secondary low pressure chamber or reservoir 236, through a dimple 238 formed in the body to the low pressure chamber 228, and then through the check valve assembly to the high pressure chamber 232. In the illustrative embodiment, a tubular baffle 240 is received over the hub within the reservoir 236 to inhibit fluid drainage when the engine is shut off; however, the baffle is not required in all engine applications.

I claim:

1. A hydraulic lash adjuster for an internal combustion engine comprising a body having a blind first bore formed therein; a plunger slidingly received within said first bore; a pressure chamber formed between the bottom of said first bore and said plunger; a fluid chamber within said plunger; a supply of hydraulic fluid within said fluid chamber; a valve opening in said plunger providing fluid communication between said fluid chamber and said pressure chamber; a check valve element for selectively opening or closing said valve opening in response to The pressure difference between said fluid chamber and said pressure chamber; spring means normally urging said plunger outward of said first bore; and seal means between said first bore and said plunger operable to prevent the flow of fluid therebetween; characterized by a second bore formed in the bottom of said plunger intersecting said valve opening, said check valve element being received completely within said second bore such that movement of said check valve element between an open and a closed position within said second bore is guided by the diameter of said bore; and means for retaining said check valve element completely within said second bore.

2. A lash adjuster as claimed in claim 1 including a valve seat surface formed between said second bore and said valve opening, the distance traveled by said valve element being dependent on the distance between said seat surface and the bottom of said plunger.

3. A lash adjuster as claimed in claim 2, in which said means for retaining said check valve element within said second bore includes a first surface in engagement with the bottom of said plunger and a second surface engageable by said check valve element in its fully open position, said first and second surfaces being coplanar.

4. A lash adjuster as claimed in claim 3, in which said retaining means comprises a cup member received over the bottom of said plunger and having an outwardly extending flange formed thereon, and said spring means comprises a coil spring acting between the bottom of said first bore and said flange.

5. A lash adjuster as claimed in claim 4 including a portion of reduced diameter extending upward from the bottom of said plunger to define a shoulder at the intersection of said reduced diameter with the full diameter of the plunger, said cup member being received over said reduced diameter, and said seal being received over said reduced diameter portion between said shoulder and the flange on said cup member.

6. A lash adjuster as claimed in claim 1 in which said second bore includes a tapered portion, said valve seat surface being defined by said tapered portion.

7. A lash adjuster as claimed in any one of claims 1 through 6 including means for conducting pressurized oil from an external supply into said fluid chamber.

8. A lash adjuster as claimed in any one of claims 1 through 6 in which said seal means comprises a resilient seal ring acting between said body and said plunger.

* * * * *